US005614701A

United States Patent [19]

Hung

[11] Patent Number: 5,614,701

[45] Date of Patent: Mar. 25, 1997

[54] CONTROL SWITCH FOR ELECTRIC WINCH

[76] Inventor: Michael Hung, 9-16, Nan Kan Hsia, Nan Kan, Lu Chu Hsiang, Tao Yuan County, Taiwan

[21] Appl. No.: 495,317

[22] Filed: Jun. 27, 1995

[51] Int. Cl.[6] ..... H01H 9/06; H01H 13/70; H01H 15/02

[52] U.S. Cl. ..... 200/61.85; 200/1 V; 200/16 A; 200/243; 200/298

[58] Field of Search ..... 200/1 R, 1 V, 200/5 R, 16 A, 243, 298

[56] References Cited

U.S. PATENT DOCUMENTS

| | | | |
|---|---|---|---|
| 2,713,092 | 7/1955 | Rucks et al. | 200/5 E |
| 3,086,090 | 4/1963 | Carroll | 200/5 E |
| 3,733,451 | 5/1973 | Kiessling | 200/293 |
| 4,896,558 | 1/1990 | Meier et al. | 74/543 |
| 5,283,406 | 2/1994 | Olsen | 200/243 |
| 5,349,148 | 9/1994 | Hung | 200/243 X |

*Primary Examiner*—J. R. Scott
*Attorney, Agent, or Firm*—Wenderoth, Lind & Ponack

[57] ABSTRACT

A control switch for an electric winch includes a handle, a set of forward and reverse push button switches and a switch box. The switch box includes a top cover and a bottom cover. The top cover is provided with a set of polarize conducting plates for DC voltage and another set of polarized conducting plates for motor wiring. The bottom cover is provided with two grooves for holding two sliding blocks, respectively. Each of the two sliding blocks is provided with conducting wipers and springs. The movement of the sliding blocks corresponds to the pushing of the forward button or the reverse button. Thus when one of the buttons is pushed, a circuit connection inside of the switch box is changed, providing control of the coiling, uncoiling and braking of a winch cable.

7 Claims, 6 Drawing Sheets

CONTROL SWITCH FOR ELECTRIC WINCH

BACKGROUND OF THE INVENTION (a) Field of the Invention

The present invention relates to a control switch for an electric winch, particularly to an improvement in a structure including a set of push button switches which provide control for the pulling, releasing, braking and stopping of an electric winch.

(b) Description of the Prior Art

The coiling and uncoiling of a steel cable of an electric winch are controlled by forward and reverse push buttons of a control switch. The switches change the polarity of the motor so that the motor can either be stopped or rotated in a clockwise or a counter-clockwise direction. In addition, the majority of conventional devices use a clutch and lining plate to complete the control after the cable is used in a lifting operation. However, this type of braking force is large which makes it unsafe to use. This type of electric winch also requires a higher current to operate, and it is easy to damage the unit during high current overload. The inventor of the present invention has developed a control switch mechanism for this purpose and has been granted with U.S. Pat. No. 5,349,148. The control switch disclosed in the patent is a push button having a V-shaped surface. Both edges of the push button are connected to positive and negative polarity circuits so that the winch can be operated to coil or uncoil the cable.

SUMMARY OF THE INVENTION

The main object of the present invention is to provide a control switch for actuating an electric winch to coil or uncoil a cable. The control switch includes a handle, a set of forward and reverse buttons, and a switch box. Two sets of polarized conducting plates are provided inside of the switch box, and are used as connections for the motor and the DC voltage source. In addition, two sliding blocks are also provided to cooperate with the corresponding pushing of the push buttons. Through the use of the retractable springs and the conducting wipers provided inside of the two sliding blocks, and a "push" on the selected forward or reverse push buttons, the sliding blocks can be displaced so that the conducting wipers of the corresponding sliding block and the two sets of polarized conducting plates can be configured into different circuits. Thus rotation of the motor can be controlled for rotation in the clockwise or counterclockwise direction, and the winch cable can be coiled or uncoiled. When the switches are in their normal positions, the two terminals of the motor are connected together, at this time, the principle of a generator applies and the twisting force of the motor is therefore enhanced, thus the braking force of the motor is also strengthened.

BRIEF DESCRIPTION OF THE DRAWINGS

The drawings disclose an illustrative embodiment of the present invention which serves to exemplify the various advantages and objects thereof, and are as follows.

DETAILED DESCRIPTION OF THE PREFERRED EMBODIMENT

Figure 1:
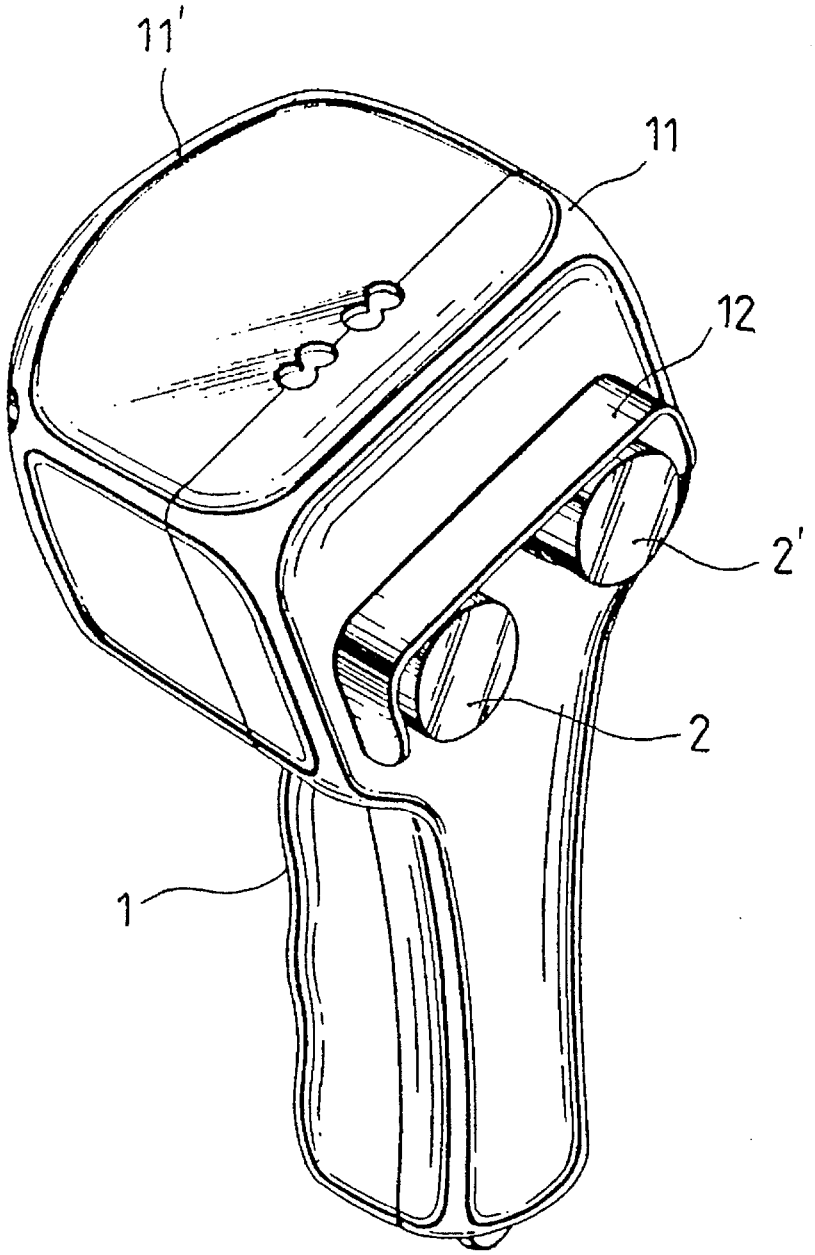
FIG. 1 is a perspective view of the present invention.
Figure 2:
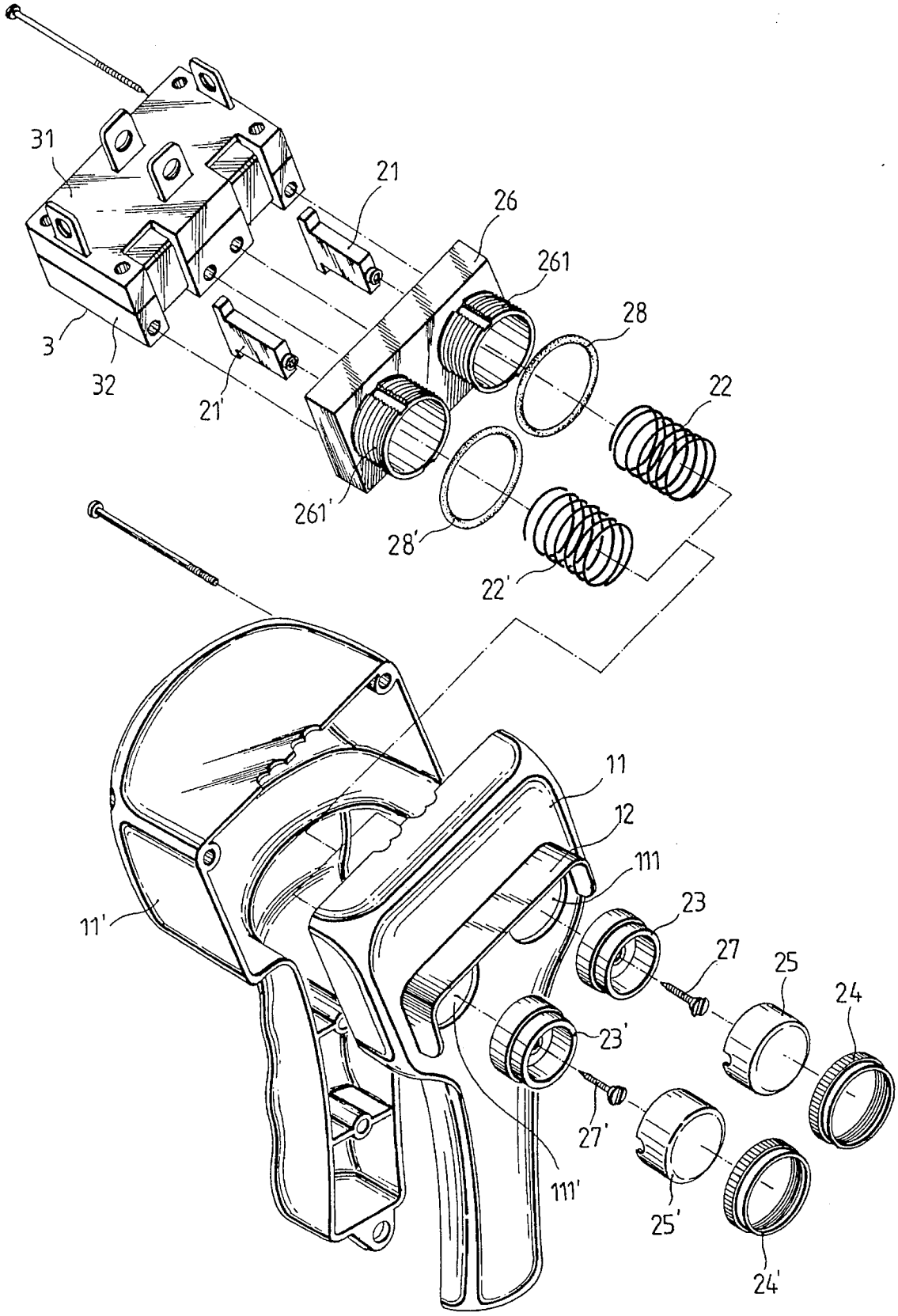
FIG. 2 is a perspective exploded view of the present invention.

As shown in FIGS. 1 and 2, the present invention includes a handle 1, a set of a forward and reverse push button switches 2, 2', and a switch box 3.

The handle 1 is formed by two hollow bodies 11, 11'. In a selected location of hollow body 11, two push button holes 111, and 111' are provided. The push button holes 111, 111' are provided for receiving push buttons 2, 2'. At a location above the holes 111, 111', a shielding plate 12 is provided and extends outward for preventing the accidental tripping of the push button switches 2, 2'.

The push button switches 2, 2' are basically of conventional structure. Each of the switches 2, 2' include a push shaft 21, 21', a retractable spring 22, 22', a removable inner ring 23, 23', an external protective ring 24, 24' and a push button body 25, 25'. A base 26 is positioned in the hollow body 11 of the handle and two hollow threaded tubes 261 261', provided at the front of the base 26, extend through the push button holes 111, 111' of the hollow body 11. The hollow threaded tubes 261, 261' are provided so that the push shaft 21, 21' can be inserted from the back of positioning base 26. In addition, the removable inner rings 23, 23' and retractable springs 22, 22' are inserted from the front of the positioning base 26, and screws 27, 27' are used for securing the inner rings 23, 23' to the push shaft 21, 21'. With the retractable springs 22, 22' in place, an assembly that can be pushed is formed. Also, washers 28, 28' can be placed between the positioning base 26 and the inner rings 23, 23' and push buttons 25, 25' can be secured in place by external protective rings 24, 24'. This forms the assembly of the conventional push button switch.

Figure 3:
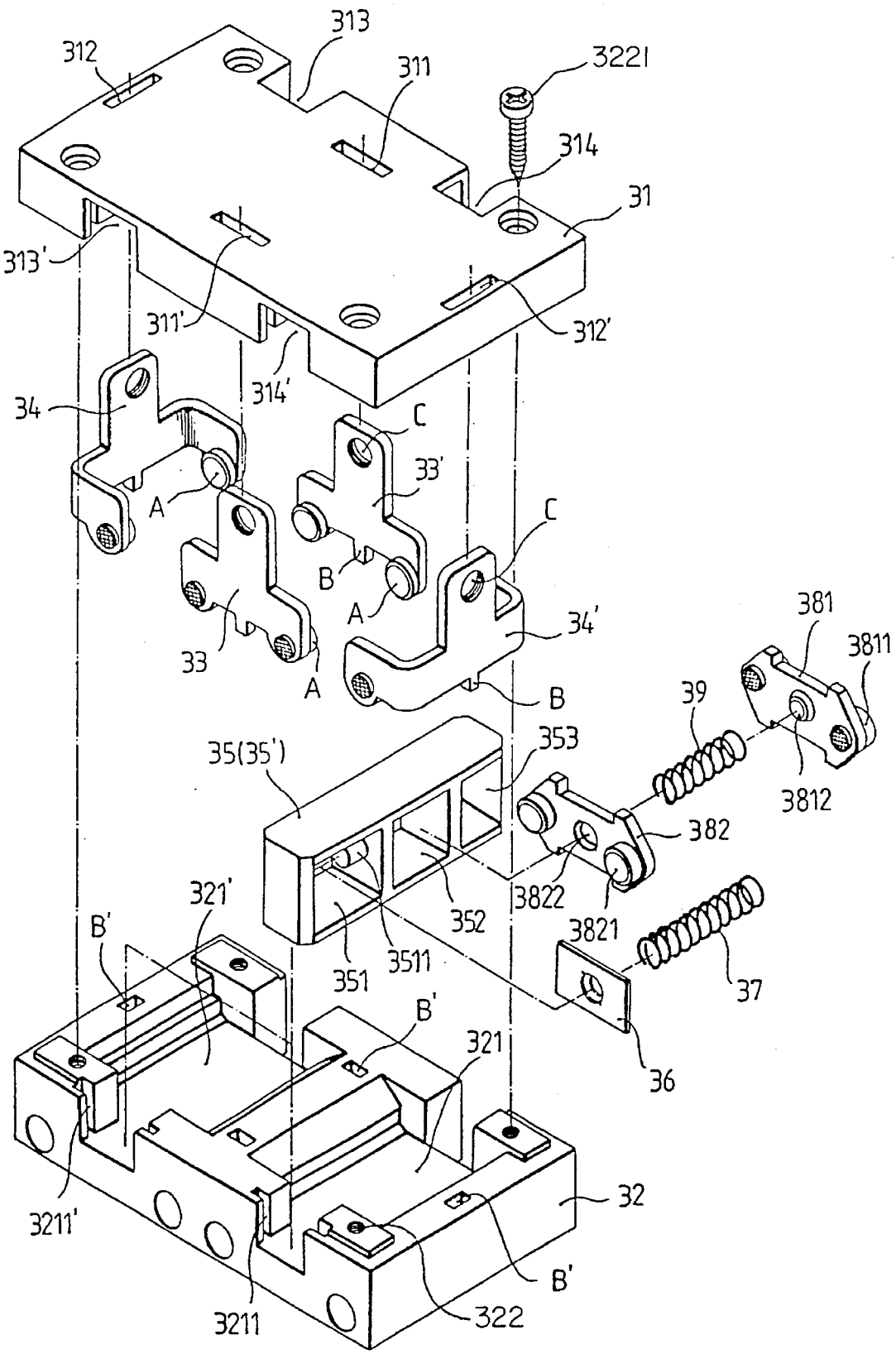
FIG. 3 is a perspective exploded view of a switch box of the present invention.
Figure 4:
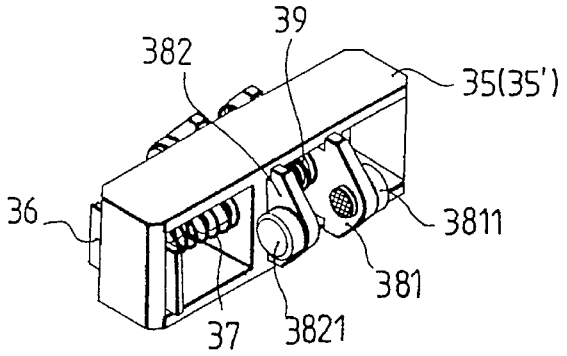
FIG. 4 is a perspective view of a sliding block assembly, provided inside the switch box, according to the present invention.
Figure 5:
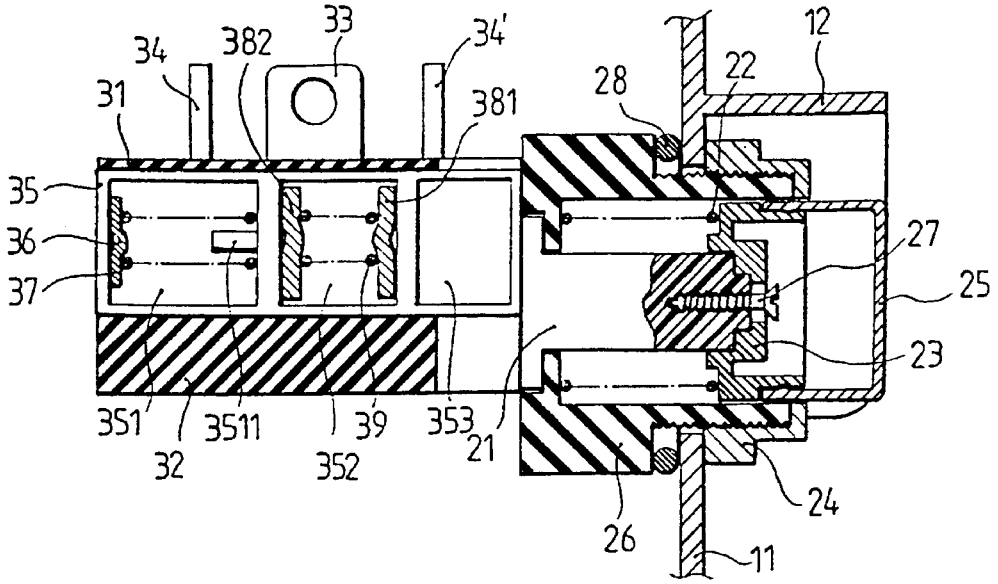
FIG. 5 is a cross-sectional view of the present invention.

As shown in FIG. 3, the switch box 3 includes a top cover 31 and a bottom cover 32. Two pairs of slots 311, 311' and 312, 312' are provided in the top cover 31. The wall of the top cover 31 is provided with corresponding grooves 313, 313' as well as notches 314, 314'. The slots 311, 311' and 312, 312' are provided such that the corresponding positive and negative conducting plates 33 and 33' for DC voltage and the positive and negative conducting plates 34 and 34' for the motor can all be received therein. The conducting plates for DC voltage 33, 33' have "T" shapes, while the contact portion of the conducting plates for the motor are bent into "U" shapes. Each of the conducting plates are provided with two inwardly facing contact surfaces A, and underneath each contact portion is a positioning stud B. The top of the conducting plates are provided with screw holes C which are used for receiving screws (not shown) to secure wiring. In addition, the bottom cover 32 can be locked together with the top cover 31. The bottom cover 32 has a surface formed with two grooves 321, 321'. Each of the grooves 321, 321' is aligned with an opening in the side walls of the bottom cover 32. The side wall opening on one side is further provided with insertion slots 3211, 3211'. The bottom cover surface is also provided with two corresponding blind holes B', which correspond to the positioning studs B received therein. Also, the aforesaid grooves 321, 321' are respectively provided for holding sliding blocks 35, 35'. As shown in FIGS. 3, 4 and 5, the sliding blocks 35 (35') are rectangular hollow bodies having three divided spaces 351, 352 and 353. An inner wall of the forward divided space 351 is provided with a support post 3511, and the other side of the forward divided space 351 is provided for the attachment of a conducting plate 36. A portion of the conducting plate 36 protrudes outwardly from the sliding block 35 so that it can be received in the insertion slot 3211 of the groove 321. Also, one end of a retractable spring 37 is positioned over the support post 3511 and the other end engages the conducting plate 36. The center space 352 is provided for accommodating two conducting wipers 381, 382. In addition to contact surfaces 3811, 3821, provided on the sides of the wipers, the center of each conducting wipers 381, 382 is fabricated with a protruding member 3812, 3822. Both ends of a second retractable spring 39 are held in place by engaging the protruding members 3812, 3822. The sliding block 35, when inserted into the groove 321 of the bottom cover 32, can be pushed against the bias of the first retractable spring 37. Similarly, the other sliding block 35' has an identical structure. The second sliding block 35' also includes two conducting wipers 381' and 382' as well as the other components (as shown in FIG. 7), and therefore its description is not repeated here.

Figure 6:
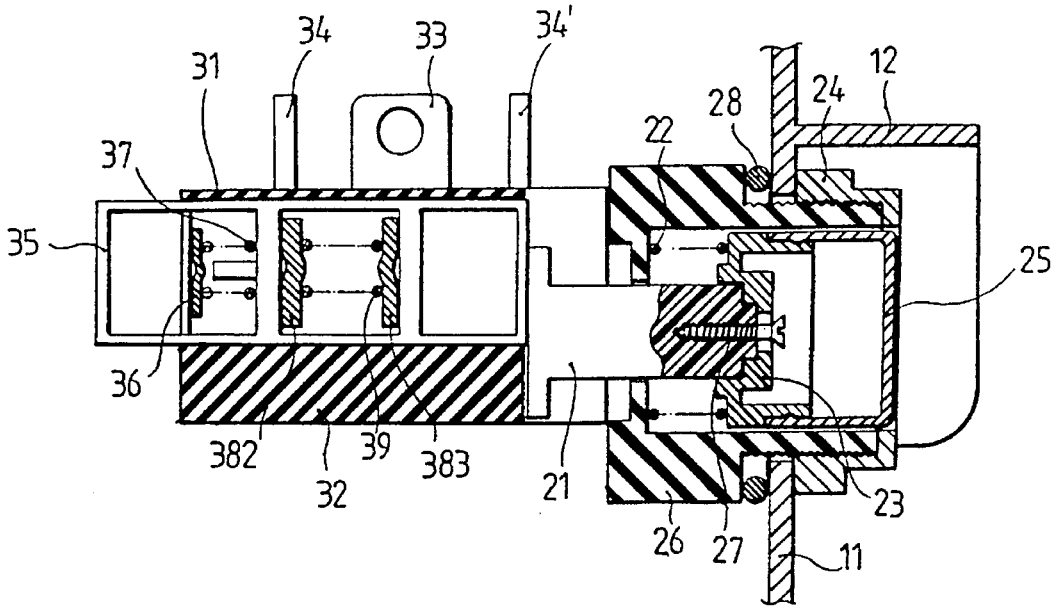
FIG. 6 is an illustrative cross-sectional view showing the operation of the push button switch according to the present invention.

The bottom cover 32 of switch 3 is provided with a plurality of holes 322 for receiving screws 3221 which are used to secure the bottom cover in place. Thus, by the handle 1 and push buttons 2 and 2', a control switch for coiling and uncoiling of an electric winch cable is formed, and its operation is shown in FIG. 6. When the push button body 25 is pressed, the push shaft 21 moves the sliding block 35 of the switch box 3 forward. Thus the conducting wipers 381 and 382 come into contact with the aforesaid positive and negative conducting plates 33 and 33' of the DC voltage, or they come into contact with the positive and negative conducting plates of the motor. This configuration permits a selection of different types of circuits, and it also controls the rotation of the motor which allows the cable to be coiled or uncoiled during an electric winch operation.

Figure 7:
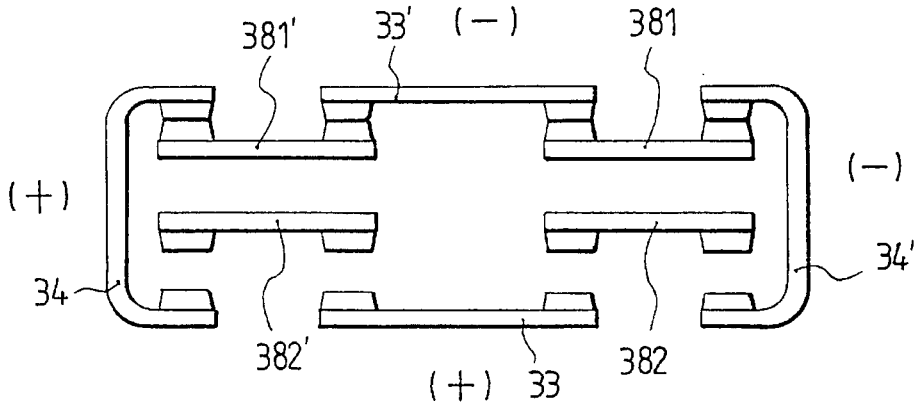
FIG. 7 shows an arrangement of the conducting plates in a normal position inside the switch box according to the present invention.
Figure 8:
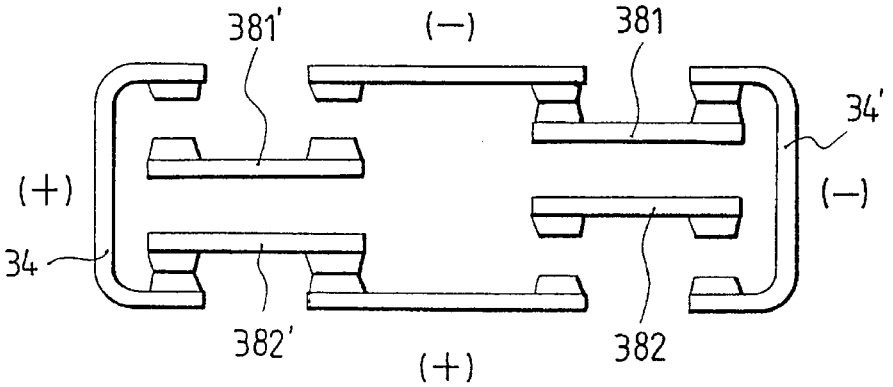
FIG. 8 shows a configuration of the conducting plates with one of the push button switches pressed.
Figure 9:
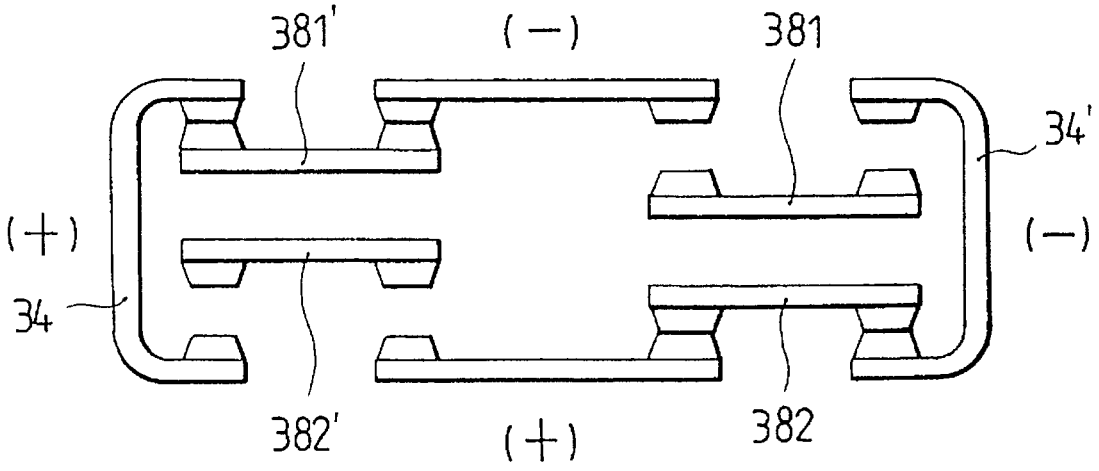
FIG. 9 shows a configuration of the conducting plates while another of the push button switches is pressed.

FIG. 7 shows the normal position, i.e. when the two push buttons are not being pushed, of the related conducting plates inside the switch box 3. In this position, the positive and negative conducting plates 34, 34' connected to the motor are in contact with the conducting wipers 381, 381' of the sliding blocks 35, 35'. Since the positive and the negative terminals of the motor are connected together, the phenomenon of a generator occurs. Thus the twisting force of the motor shaft is increased, which naturally strengthens the braking force of the motor shaft. As shown in FIGS. 8 and 9, the forward button 2 and the reverse button 2' have been pushed, respectively. Through the conducting wipers 382, 382' on the other sliding block 35', the motor can either be connected to the positive or the negative terminals of the DC voltage, allowing the motor to be controlled so as to effect rotation in a clockwise or a counter-clockwise direction. This in turn controls coiling and uncoiling of the electric winch cable.

What is claimed is:

1. A control switch comprising:

a) a handle having two holes;

b) two push buttons extending through said holes, respectively; and c) a switch box positioned in said handle, said switch box including:

a top cover having a plurality of slots extending therethrough;

a bottom cover defining a first open-ended groove and a second open-ended groove, wherein each of said first and second open-ended grooves has an insertion slot formed adjacent an end thereof;

a first pair of conducting plates secured between said top and bottom covers, each of said plates having two inwardly facing contact surfaces and a top wire securing portion;

a second pair of conducting plates secured between said top and bottom covers, each of said plates having two inwardly facing contact surfaces and a top wire securing portion;

a first sliding block located in said first open-ended groove and being slidable therein upon movement of one of said two push buttons, said first sliding block defining forward, center and rear divided spaces, wherein a plate is positioned on an inner wall of said forward divided space and is inserted in said insertion slot of said first open-ended groove; and a second sliding block located in said second open-ended groove and being slidable therein upon movement of the other of said two push buttons, said second sliding block defining forward, center and rear divided spaces, wherein a plate is positioned on an inner wall of said forward divided space and is inserted in said insertion slot of said second open-ended groove.

2. The control switch as claimed in claim 1, wherein each of said first and second sliding boxes include:

a support post extending from an inner wall of said forward divided space;

a first spring positioned over said support post and engaged with said plate;

two conducting wipers positioned in said center divided space; and a second spring positioned between said two conducting wipers.

3. The control switch as claimed in claim 2, wherein:

said top cover includes a planar wall and a side wall extending downwardly from a peripheral edge of said planar wall;

said planar wall has a plurality of slots;

said top portions of said conducting plates extend through said slots in said top cover, respectively, and said side wall has grooves receiving said conducting plates, and notches corresponding to said open-ended grooves, respectively.

4. The control switch as claimed in claim 2, wherein:

said bottom cover has a plurality of holes;

each of said conducting plates has a positioning stud which is received in one of said plurality of holes; and each of said top portions of said conducting plates has a screw hole for securing wiring with a screw.

5. The control switch as claimed in claim 2, wherein said handle includes an outwardly extending shielding plate which is positioned adjacent to and above said push buttons.

6. The control switch as claimed in claim 2, wherein said first pair of conducting plates are T-shaped plates, and said second pair of conducting plates are U-shaped plates.

7. The control switch as claimed in claim 6, wherein:

said bottom cover has a plurality of holes;

each of said conducting plates has a positioning stud which is received in one of said plurality of holes; and each of said top portions of said conducting plates has a screw hole for securing wiring with a screw.

* * * * *